US009647306B2

(12) United States Patent
Darling et al.

(10) Patent No.: US 9,647,306 B2
(45) Date of Patent: May 9, 2017

(54) RF FILTER COMPRISING N COAXIAL RESONATORS ARRANGED IN A SPECIFIED INTERDIGITATION PATTERN

(71) Applicant: SKYWORKS SOLUTIONS, INC., Woburn, MA (US)

(72) Inventors: John Kenneth Darling, New Market, MD (US); Robert Allen Burk, Brunswick, MD (US)

(73) Assignee: Skyworks Solutions, Inc., Woburn, MA (US)

( * ) Notice: Subject to any disclaimer, the term of this patent is extended or adjusted under 35 U.S.C. 154(b) by 0 days.

(21) Appl. No.: 14/637,781

(22) Filed: Mar. 4, 2015

(65) Prior Publication Data

US 2016/0261014 A1 Sep. 8, 2016

(51) Int. Cl.
*H01P 1/205* (2006.01)

(52) U.S. Cl.
CPC ..... *H01P 1/2053* (2013.01)

(58) Field of Classification Search
CPC ..... H01P 1/205; H01P 1/2053; H01P 1/2056; H01P 7/04
USPC ..... 333/206, 222
See application file for complete search history.

(56) References Cited

U.S. PATENT DOCUMENTS 6,294,968 B1 * 9/2001 Ito et al. ..... H01P 1/2053 333/202
2003/0184416 A1 * 10/2003 Ono et al. ..... H01P 1/205 333/206

* cited by examiner

*Primary Examiner* — Benny Lee
(74) *Attorney, Agent, or Firm* — Chang & Hale LLP

(57) ABSTRACT

Devices and methods related to multiple-pole ceramic resonator filters. In some embodiments, a radio-frequency (RF) filter can include a first coaxial resonator in a first orientation and having an input tab on a first side of the filter, and an N-th coaxial resonator in the first orientation and having an output tab on the first side of the filter. The RF filter can further include second and (N−1)th coaxial resonators, each in a second orientation opposite the first orientation to form first and second interdigitations with the first and N-th resonators, respectively. The RF filter can further include at least two coaxial resonators in the first orientation and coupled between the second and (N−1)th resonators. The N resonators can be slot coupled between the first and N-th resonators. The first and second interdigitations can be configured to provide enhancement of the slot coupling between the first and N-th resonators.

18 Claims, 6 Drawing Sheets

RF FILTER COMPRISING N COAXIAL RESONATORS ARRANGED IN A SPECIFIED INTERDIGITATION PATTERN

BACKGROUND

Field

The present disclosure generally relates to ceramic resonator filters.

Description of the Related Art

Some ceramic materials have properties that make them suitable for radio-frequency (RF) applications. Such applications can include RF resonators which can be utilized in devices such as filters.

SUMMARY OF THE INVENTION

In a number of implementations, the present disclosure relates to a radio-frequency (RF) filter that includes a first coaxial resonator in a first orientation and having an input tab on a first side of the filter. The filter further includes an N-th coaxial resonator in the first orientation and having an output tab on the first side of the filter. The filter further includes a second coaxial resonator in a second orientation opposite the first orientation so as to form a first interdigitation with the first resonator. The filter further includes an (N−1)th coaxial resonator in the second orientation so as to form a second interdigitation with the N-th resonator. The filter further includes at least two coaxial resonators in the first orientation and coupled between the second and (N−1) th resonators. The N resonators are configured to provide slot coupling between the first and the N-th resonators, with the first and second interdigitations being configured to provide enhancement of the slot coupling between the first and N-th resonators.

In some embodiments, each of the coaxial resonators can include a ceramic coaxial resonator. In some embodiments, each of the ceramic coaxial resonator can be configured as a quarter-wave resonator. In some embodiments, each of the quarter-wave resonators can include a non-metalized end and a metalized end, with the metalized end being electrically connected to a ground.

In some embodiments, the quantity N can be an integer greater than or equal to 6. In some embodiments, each of the first, third, fourth and sixth resonators can have its non-metalized end facing the first side of the filter, and each of the second and fifth resonators can have its metalized end facing the first side of the filter.

In some embodiments, the filter can further include an input tab disposed on the non-metalized end of the first resonator and an output tab disposed on the non-metalized end of the N-th resonator. In some embodiments, the filter can further include an input capacitor and an output capacitor, with the input tab being connected to one side of the input capacitor, and the output tab being connected to one side of the output capacitor. In some embodiments, the filter can further include an input connector and an output connector, with the input connector being connected to the other side of the input capacitor, and the output connector being connected to the other side of the output capacitor. In some embodiments, the input and output connectors, input and output capacitors, and input and output tabs are substantial mirror images of each other.

In accordance with a number of implementations, the present disclosure relates to a method for fabricating a radio-frequency (RF) filter. The method includes mounting a first coaxial resonator in a first orientation on a circuit board such that the first resonator's input tab is on a first side of the filter. The method further includes mounting an N-th coaxial resonator in the first orientation on the circuit board such that the N-th resonator's output tab is on the first side of the filter. The method further includes mounting a second coaxial resonator in a second orientation opposite the first orientation on the circuit board so as to form a first interdigitation with the first resonator. The method further includes mounting an (N−1)th coaxial resonator in the second orientation on the circuit board so as to form a second interdigitation with the N-th resonator. The method further includes at least two coaxial resonators in the first orientation and coupled between the second and (N−1)th resonators. The N resonators are configured to provide slot coupling between the first and the N-th resonators, and the first and second interdigitations are configured to provide enhancement of the slot coupling between the first and N-th resonators.

In some implementations, the present disclosure relates to a radio-frequency (RF) filter having an even number of ceramic coaxial resonators configured so as to provide slot coupling among the resonators between an input node and an output node. At least some of the resonators are arranged in an interdigitated manner such that the input node and the output node are located on a common side of the filter. In some embodiments, the at least some resonators being interdigitated can provide enhanced band pass performance of the filter.

According to some implementations, the present disclosure relates to a radio-frequency (RF) device having a first RF component configured to generate an RF signal. The device further includes a band pass RF filter that includes an even number of ceramic coaxial resonators configured so as to provide slot coupling among the resonators between an input node and an output node. At least some of the resonators are arranged in an interdigitated manner such that the input node and the output node are located on a common side of the filter. The input node is connected to the first RF component so as to receive the RF signal as an input, and the filter is configured to yield a band pass filtered RF signal as an output. The device further includes a second RF component connected to the output node of the filter and configured to receive the band pass filtered RF signal.

In some embodiments, the RF device can include a wireless device. In some embodiments, the wireless device can include a device associated with a cellular system. In some embodiments, the RF device can include a wire-based device. In some embodiments, the wire-based device can include a device associated with a cable television system.

According to a number of implementations, the present disclosure relates to a method for fabricating a radio-frequency (RF) filter. The method includes providing an even number of slot coupling ceramic coaxial resonators. The method further includes arranging the resonators such that at least some of the resonators are interdigitated, and such that an input node and an output node for the resonators are located on a common side of the filter.

For purposes of summarizing the disclosure, certain aspects, advantages and novel features of the inventions have been described herein. It is to be understood that not necessarily all such advantages may be achieved in accordance with any particular embodiment of the invention. Thus, the invention may be embodied or carried out in a manner that achieves or optimizes one advantage or group of advantages as taught herein without necessarily achieving other advantages as may be taught or suggested herein.

DETAILED DESCRIPTION OF SOME EMBODIMENTS

The headings provided herein, if any, are for convenience only and do not necessarily affect the scope or meaning of the claimed invention.

Disclosed herein are devices and methodologies related to radio-frequency (RF) filters having a plurality of ceramic coaxial resonators (also referred to as coaxial line elements). Depending on size and/or dielectric constant, such resonators can be configured to operate from about 300 MHz to about 6 GHz. Some advantageous features provided by ceramic coaxial resonators can include, for example, a desirable combination of performance and miniaturization in VHF/UHF bands where use of discrete inductors and capacitors can be awkward. Ceramic coaxial resonators can also provide advantages of high Q factor, reduced size, improved shielding, and/or temperature performance.

A ceramic coaxial resonator having some or all of the foregoing features typically has its outer and inner walls metalized. A half-wave ($\lambda/2$) resonator has both ends un-metalized; and a quarter-wave ($\lambda/4$) resonator has one end metalized and the other end un-metalized so as to provide open and short configurations, respectively.

A group of ceramic coaxial resonators as described herein can be assembled together so as to be RF coupled and function as an RF filter. In some implementations, such coupling of RF energy between two adjacent resonators can be achieved by slots formed on the facing surfaces of the two resonators. A width dimension of such a slot can be approximately proportional to a coupling constant within a range. If the slots have widths outside of such a range, electrical performance of the filter can be degraded.

Figure 1A:
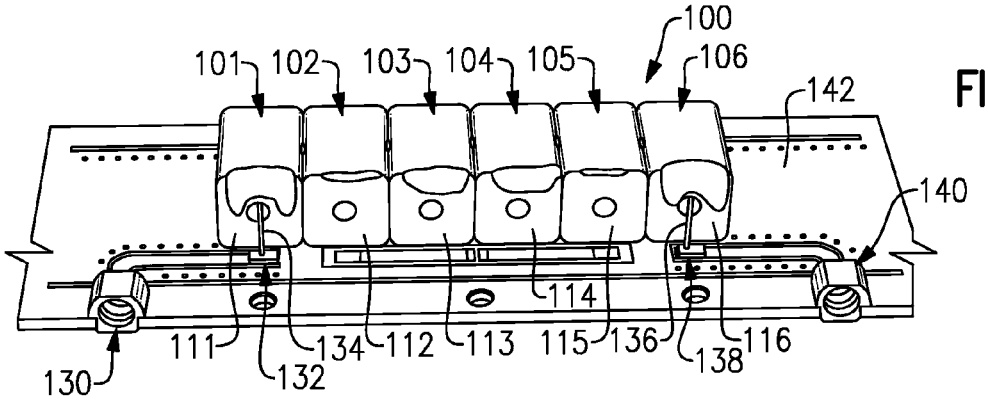
FIGS. 1A-1E show various views of an example radio-frequency (RF) filter having selected interdigitation of coaxial resonators.
Figure 1B:
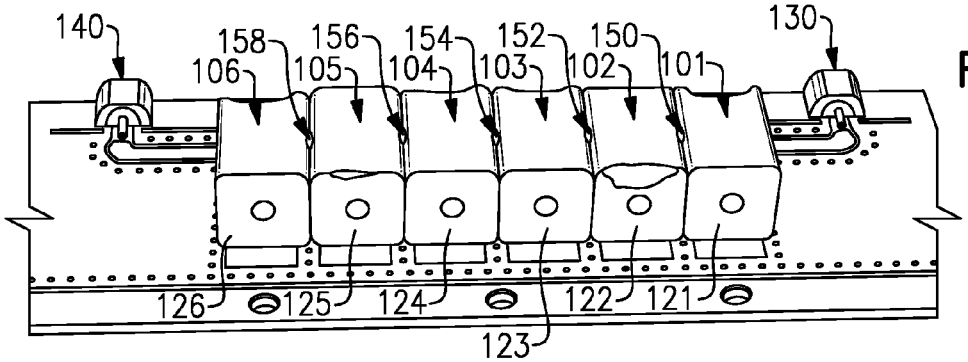
Figure 1C:
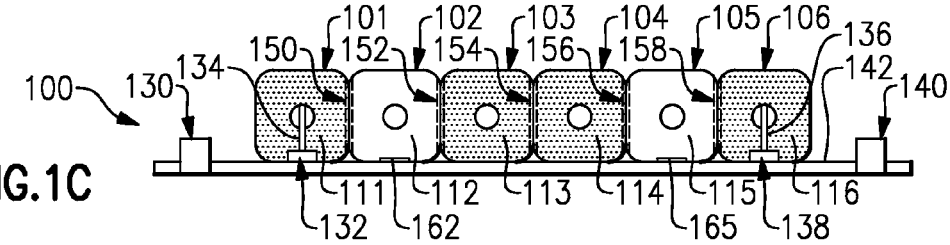
Figure 1D:
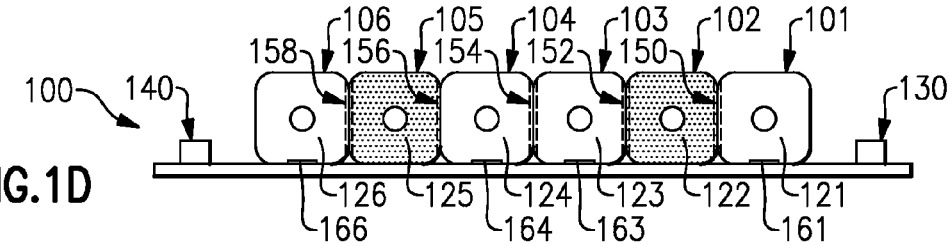
Figure 1E:
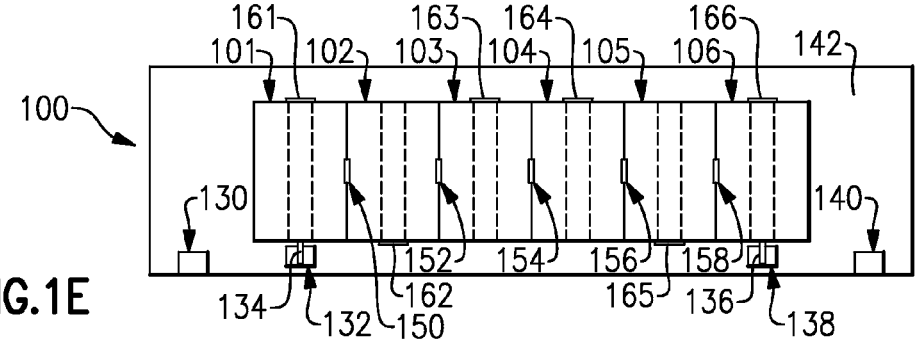

FIGS. 1A-1E show various views of an example RF filter 100 (FIGS. 1A, 1C, 1D and 1E) having six ceramic coaxial resonators (101, 102, 103, 104, 105, 106) arranged in a manner as described herein. FIG. 1A shows a front perspective view of the filter 100. Similarly, FIG. 1B shows a back perspective view, FIG. 1C shows a front side view, FIG. 1D shows a back side view, and FIG. 1E shows a plan view of the example filter 100. As described herein, RF filters having one or more features associated with the example filter 100 can include other numbers of ceramic coaxial resonators.

The six resonators (101-106) are shown to be mounted on a PCB substrate 142 (FIGS. 1A, 1C and 1E) and arranged so as to be RF coupled via coupling slot pairs indicated as 150, 152, 154, 156, 158 (FIGS. 1B, 1C, 1D and 1E). The six resonators are also shown to have front ends 111, 112, 113, 114, 115, 116 (FIGS. 1A and 1C) and back ends 121, 122, 123, 124, 125, 126 (FIGS. 1B and 1D). An input tab 134 (FIGS. 1A, 1C and 1D) for providing an input RF signal is shown to be positioned at the front end 111 of the first resonator 101, and an output tab 136 (FIGS. 1A, 1C and 1E) for outputting a filtered RF signal is shown to be positioned at the front end 116 of the sixth resonator 106. The input tab 134 is electrically connected to a capacitor 132 (FIGS. 1A, 1C and 1E) which is in turn electrically connected to an input connector 130. Similarly, the output tab 136 is electrically connected to a capacitor 138 (FIGS. 1A, 1C and 1E) which is in turn electrically connected to an output connector 140.

In FIGS. 1C and 1D, a metalized end of a resonator is depicted as being un-shaded, and a non-metalized end is depicted as being shaded. Accordingly, the front ends 111, 113, 114, 116 corresponding to the first (101), third (103), fourth (104) and sixth (106) resonators are non-metalized as shown in FIG. 1C, and the remaining front ends 112, 115 corresponding to the second (102) and fifth (105) resonators are metalized. The back ends 121, 123, 124, 126 corresponding to the first (101), third (103), fourth (104) and sixth (106) resonators are metalized, and the remaining back ends 122, 125 corresponding to the second (102) and fifth (105) resonators are non-metalized as shown in FIG. 1D. Accordingly, each of the six resonators operate as a quarter-wave resonator. Each of the metalized front and back ends of the foregoing example is connected to a ground. Such ground connections are depicted in FIGS. 1C-1E by connections 161 (FIGS. 1D and 1E), 162 (FIGS. 1C and 1E), 163 (FIG. 1D), 164 (FIG. 1D), 165 (FIGS. 1C and 1E), 166 (FIG. 1D).

It is noted that in the foregoing example, the first, third, fourth and sixth resonators are in a first orientation with their front ends facing the front side where the input and output connectors (130, 140) are, and the second and fifth resonators are in a second orientation with their back ends facing the front side. Accordingly, the second resonator 102 is in an interdigitated configuration between the first and third resonators 101, 103. Similarly, the fifth resonator 105 is interdigitated between the fourth and sixth resonators 104, 106. It is noted that a sub-group of the third, fourth and fifth resonators are all in the first orientation so as to be in a comb-line configuration.

Based on the foregoing example, one can see that the resonators in the filter 100 have selected interdigitation of resonator orientations. For the purpose of description herein, it will be understood that a "full interdigitation" configuration has all of the resonators in alternating orientations.

Further, "selected interdigitation" or simply "interdigitation" as described herein includes non-full interdigitation configurations having some alternating orientations of the resonators.

As applied to the example of FIGS. 1A-1E, the selected interdigitation allows both of the input and output of the filter 100 to be maintained at a common reference plane (e.g., front side) of the filter 100 using an even number of resonators. For a full interdigitation configuration, an even number of resonators will result in the input and output to be on the opposite sides. While it is possible to route one of the two (input and output) to the other side so as to have both connectable on the same side, the extra connection length can impact the electrical property of the filter (e.g., by undesirably changing the inductance).

Any number of resonators arranged in a comb-line configuration can have a common reference plane for input and output connections, since all of the resonators are in a common orientation. As described herein, providing interdigitation can yield a significant improvement in performance.

Figure 2A:
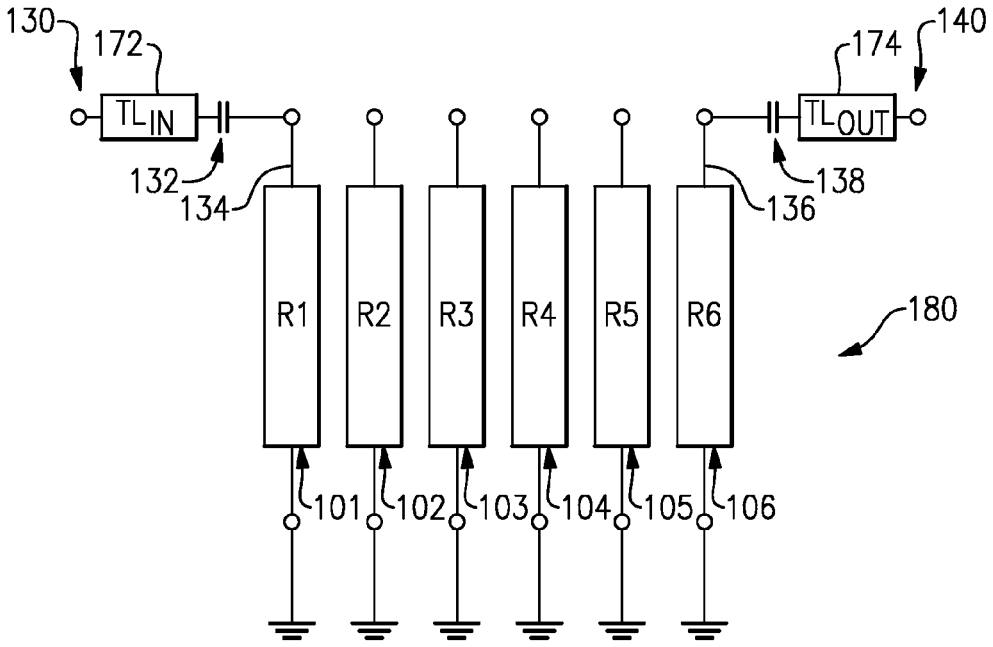
FIG. 2A shows a circuit representation of a filter having the coaxial resonators of FIGS. 1A-1E arranged in a comb-line configuration so as to be without interdigitation.
Figure 2B:
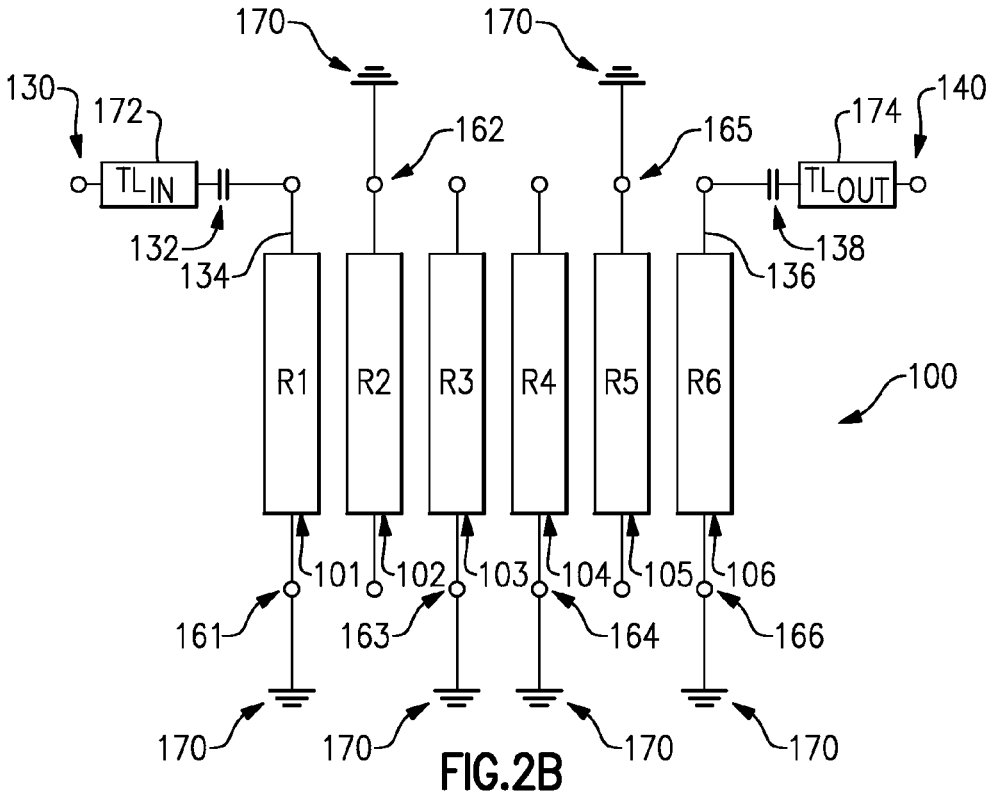
FIG. 2B shows a circuit representation of the filter of FIGS. 1A-1E, with the selected interdigitation.

FIGS. 2A and 2B show circuit representations of RF filters having the components described in reference to FIG. 1. FIG. 2A shows a configuration 180 without the selected interdigitation feature, such that all of the six resonators 101-106 are oriented the same. More specifically, all of the six resonators are grounded on the side opposite from the side where input and output connector nodes 130, 140, respectively, are at. Other than the foregoing comb-line configuration of the resonators, other components are configured substantially the same as the circuit of FIG. 2B.

FIG. 2B shows a circuit representation of the example RF filter 100 of FIG. 1. The input connector is represented as a node 130, and the output connector as a node 140. The input and output capacitors are indicated as 132 and 138, respectively (also 132 and 138 in FIG. 2A). The connection between the input connector node 130 and the input capacitor 132 is indicated as a transmission line element ($TL_{in}$) 172 (also $TL_{in}$ 172 in FIG. 2A), and the connection between the output capacitor 138 and the output connector node 140 is indicated as a transmission line element ($TL_{out}$) 174 (also $TL_{out}$ 174 in FIG. 2A). The input and output tabs are indicated as input and output lines 134 and 136 (also 134 and 136 in FIG. 2A), respectively. The six resonators R1, R2, R3, R4, R5 and R6 are depicted as corresponding line elements 101-106 in FIGS. 2A and 2B. The selected interdigitation arrangement is depicted by orientation of the ground connection nodes 161-166 and their connections to a ground 170. More specifically, the first (101), third (103), fourth (104) and sixth (106) resonators are grounded on the back side, and the second (102) and fifth (105) resonators are grounded on the front side.

Figure 3A:
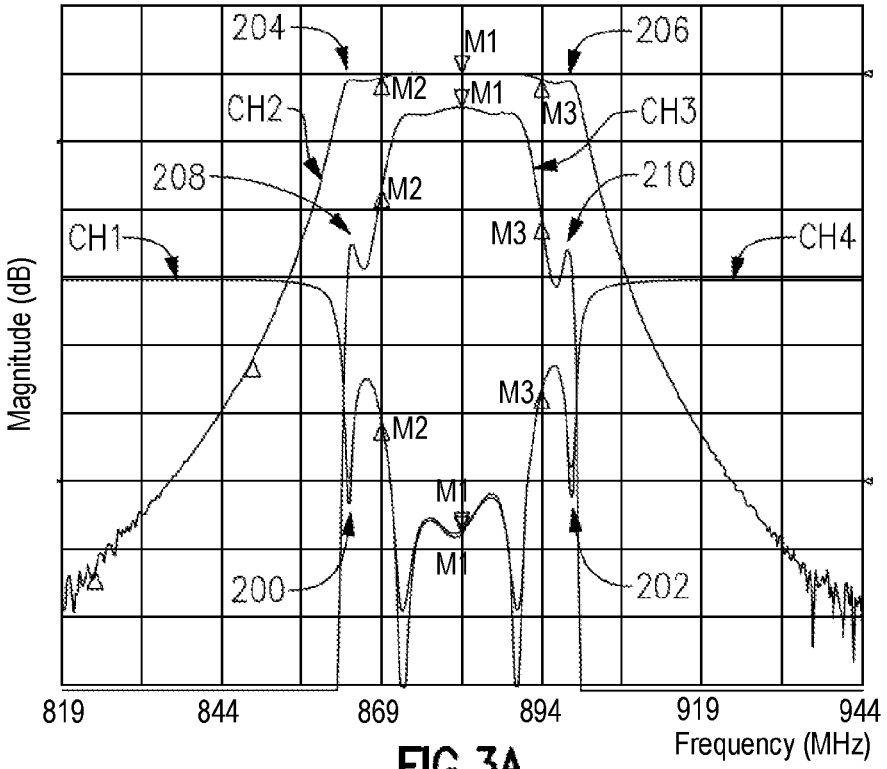
FIG. 3A shows example response plots of a band pass filter corresponding to the circuit of FIG. 2A without the selected interdigitation.
Figure 3B:
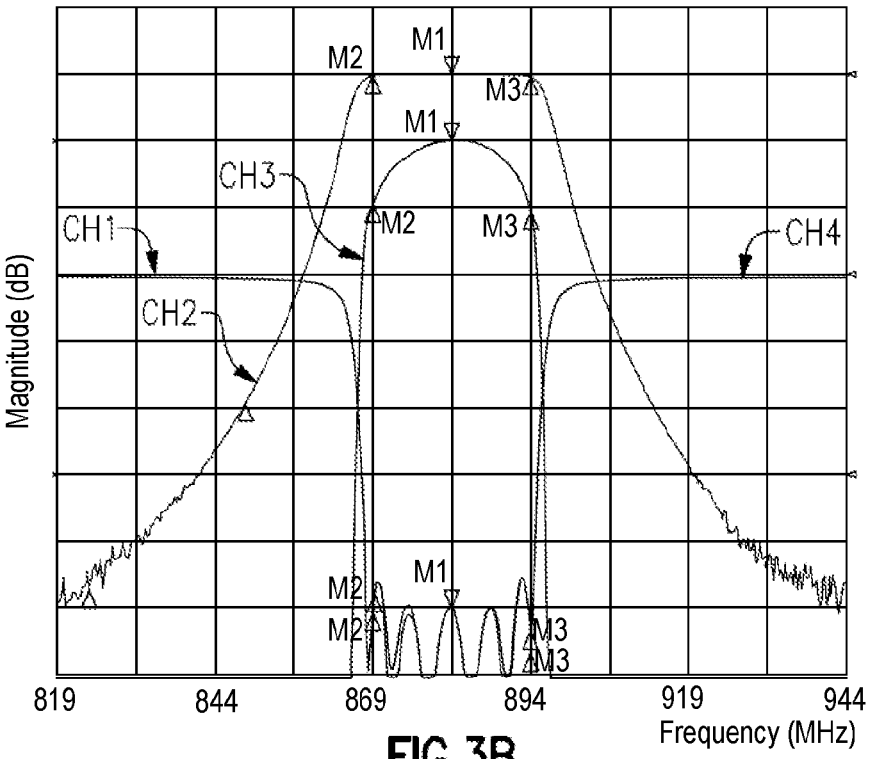
FIG. 3B shows example response plots of a band pass filter corresponding to the circuit of FIG. 2B with the selected interdigitation.

FIG. 3A shows example band pass response plots (i.e., Magnitude in dB vs. Frequency in GHz) corresponding to the filter circuit (without interdigitation) of FIG. 2A. FIG. 3B shows example response plots (i.e., Magnitude in dB vs. Frequency in GHz) corresponding to the filter circuit (with selected interdigitation) of FIG. 2B. In both figures, "CH1" corresponds to S11 response parameter (reflection back from the input), "CH2" corresponds to S21 response parameter (forward power transfer from the input to the output), "CH3" corresponds to S12 response parameter (reverse power transfer from the output to the input), and "CH4" corresponds to S22 response parameter (reflection back from the output). Also in both figures, the center frequency (markers "M1") is at approximately 881.5 MHz, and the upper (markers "M3") and lower (markers "M2") cutoff frequencies are at approximately 894.0 MHz and 869.0 MHz, respectively (to yield a bandwidth of approximately 25.0 MHz). In both of FIGS. 3A and 3B, the response curves CH1, CH2, CH3 and CH4 have following vertical scales: 5 dB per division for CH1, 10 dB per division for CH2, 0.6 dB per division for CH3, and 5 dB per division for CH4. In FIG. 3A, for the response curve CH1, M1 has a value of approximately −18.5 dB, M2 has a value of approximately −10.3 dB, and M3 has a value of approximately −7.9 dB; for the response curve CH2, M1 has a value of approximately 0.0 dB, M2 has a value of approximately −0.7 dB, and M3 has a value of approximately −1.0 dB; for the response curve CH3, M1 has a value of approximately −1.1 dB, M2 has a value of approximately −1.8 dB, and M3 has a value of approximately −2.1 dB; and for the response curve CH4, M1 has a value of approximately −18.7 dB, M2 has a value of approximately −10.5 dB, and M3 has a value of approximately −8.0 dB. In FIG. 3B, for the response curve CH1, M1 has a value of approximately −24.9 dB, M2 has a value of approximately −25.1 dB, and M3 has a value of approximately −28.1 dB; for the response curve CH2, M1 has a value of approximately 0.0 dB, M2 has a value of approximately −0.6 dB, and M3 has a value of approximately −0.6 dB; for the response curve CH3, M1 has a value of approximately −1.2 dB, M2 has a value of approximately −1.7 dB, and M3 has a value of approximately −1.8 dB; and for the response curve CH4, M1 has a value of approximately −24.8 dB, M2 has a value of approximately −23.8 dB, and M3 has a value of approximately −26.8 dB.

In the S-parameter response curves of FIG. 3A (without interdigitation), one can see significant contributions outside of the band pass region. More specifically, features indicated as 200 are significant and undesirable responses below the lower cutoff frequency for the S11 and S22 parameters. Similarly, features indicated as 202 are significant and undesirable responses above the upper cutoff frequency for the S11 and S22 parameters. For the forward power transmission parameter S21, a feature indicated as 204 is a significant and undesirable response below the lower cutoff frequency, and a feature indicated as 206 is a significant and undesirable response above the upper cutoff frequency. For the reverse power transmission parameter S12, a feature indicated as 208 is a significant and undesirable response below the lower cutoff frequency, and a feature indicated as 210 is a significant and undesirable response above the upper cutoff frequency.

In the S-parameter response curves of FIG. 3B (with selected interdigitation), the features 200, 202, 204, 206, 208, 210 of FIG. 3A are desirably absent from the respective responses.

While it is not desired or intended to be bound by any particular theory, the improved performance manifested by selected interdigitation may be due to the interdigitating of the first two resonators (R1 and R2 in FIG. 2B) and the last two resonators (R5 and R6) enhancing coupling coefficients for more efficient couplings with the middle resonators (R3 and R4). It is also noted that such an advantageous functionality provided with interdigitation can be achieved while maintaining a common reference plane for the input and output.

In some situations, coupling enhancements for the inner resonators (e.g., R3 and R4) can be attempted in a non-interdigitated configuration by increasing the widths of the coupling slots. However, such a width-increase can approach a maximum width with little or no increase in the electrical performance. With the selected interdigitation methodology described herein, more achievable slot dimensions can be incorporated while meeting the electrical performance of the desired response.

Various features described in reference to FIGS. 1A-1E, 2A, 2B, 3A and 3B are generally in the context of six resonators arranged in a single layer. Also, the performance comparison described in reference to FIGS. 2A, 2B, 3A and 3B are in the context of the example resonators described herein. It will be understood, however, that one or more features of the present disclosure can be implemented in a number of other configurations associated with resonator configurations and/or arrangement of such resonators.

Figure 4:
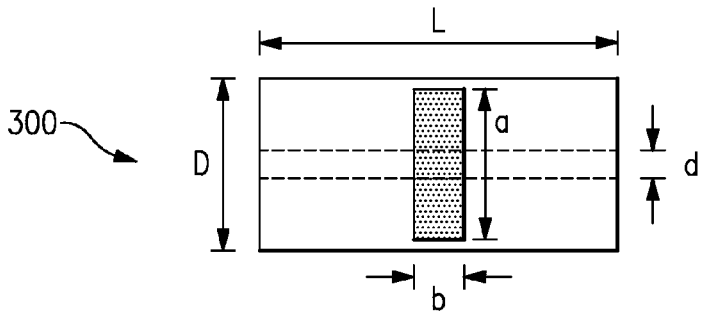
FIG. 4 shows a more detailed view of a coaxial resonator that can be slot coupled with another coaxial resonator so as to allow fabrication of filters such as the example of FIGS. 1A-1E.

FIG. 4 shows that a coaxial resonator 300 having a coupling slot can be utilized to construct a filter having one or more features as described herein. The resonator 300 is shown to have an overall length L and an overall width D. The inner hole is shown to have a diameter d. The slot is shown to have a dimension of a×b. An appropriate combination of the foregoing dimension parameters and other parameters such as dielectric material and metallization can be implemented to yield a resonator having operating parameters such as resonance frequency, Q factor, and power handling capability.

For a metalized resonator, its resonance frequency can be tuned by removing metallization. For example, resonance frequency can be increased by removing metallization from an area near the non-metalized end. Resonance frequency can be decreased by removing metallization from the shorted (metalized) end. In the example filter 100 shown in FIGS. 1A and 1B, one can see that material has been removed from areas near the non-metalized ends of the resonators, thereby increasing resonance frequencies of the resonators.

Figure 5A:
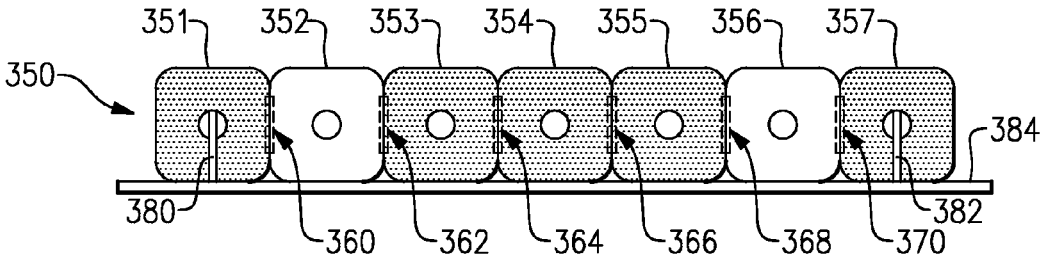
FIGS. 5A-5C show non-limiting examples of filter configurations utilizing one or more features of the present disclosure.
Figure 5B:
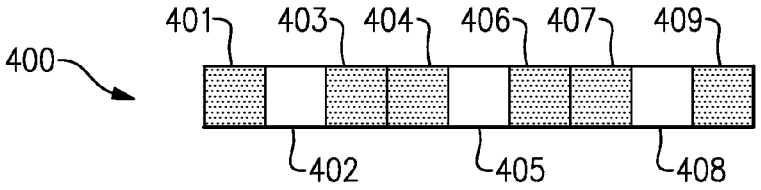
Figure 5C:
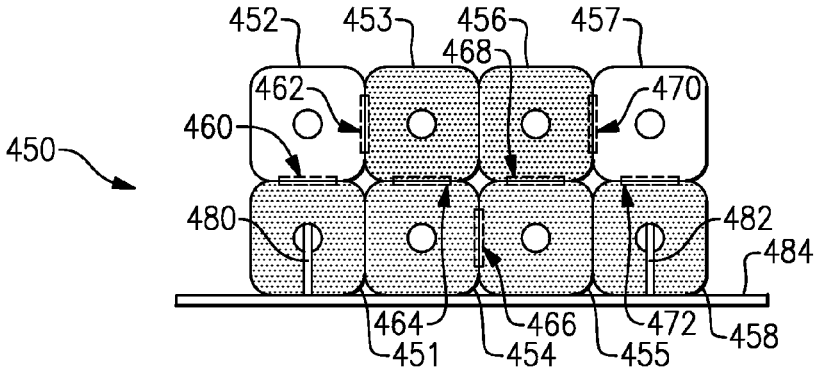

Non-limiting examples of configurations (other than the example of FIG. 1) having one or more features as described herein are shown in FIGS. 5A-5C. In an example configuration 350 of FIG. 5A, an extra resonator 354 is provided between a middle pair of resonators 353 and 355. The input pair of interdigitated resonators 351 and 352 and the output pair of interdigitated resonators 357 and 356 can be similar to the end pairs described in reference to FIGS. 1A-1E. Accordingly, an input tab 380 and an output tab 382 can facilitate input and output of RF signals. The seven resonators 351-357 can be coupled by coupling slots indicated as 360, 362, 364, 366, 368, 370. The foregoing assembly of resonators is shown to be mounted on a substrate 384 so as to yield a configuration where selected interdigitation yields input and output locations on a common plane.

An example configuration 400 of FIG. 5B can be considered to be an extension of the 6-resonator configuration of FIGS. 1A-1E. Thus, resonators 401, 402, 403, 404, 405 and 406 can be similar to the six resonators of the filter 100. A seventh resonator 407 can be oriented same as the sixth resonator 406, followed by interdigitated end pair 408 and 409. Accordingly, interdigitation of the first and second resonators 401, 402 and interdigitation of fifth and sixth resonators 405, 406 can provide enhanced coupling coefficients for more efficient couplings with third and fourth resonators 403, 404. Similarly, interdigitation of the fourth and fifth resonators 404, 405 and interdigitation of ninth and eighth resonators 409, 408 can provide enhanced coupling coefficients for more efficient couplings with sixth and seventh resonators 406, 407.

FIG. 5C shows that in some embodiments, one or more features of the present disclosure can be implemented in resonators arranged in more than one level. In an example configuration 450, an input signal can be provided to a first resonator 451 via a tab 480. A second resonator 452 is interdigitated with the first resonator 451 and slot-coupled (460). A third resonator 453 is interdigitated with the second resonator 452 and slot-coupled (462). A fourth resonator 454 is slot-coupled (464) with the third resonator 453 in a non-interdigitated manner. A fifth resonator 455 is slot-coupled (466) with the fourth resonator 454 in a non-interdigitated manner. A sixth resonator 456 is slot-coupled (468) with the fifth resonator 455 in a non-interdigitated manner. A seventh resonator 457 is interdigitated with the sixth resonator 456 and slot-coupled (470). An eighth resonator 458 is interdigitated with the seventh resonator 457 and slot-coupled (472). An output signal can be provided from the eighth resonator 458 via a tab 482. One can see that the first, fourth, fifth and eighth resonators (451, 454, 455, 458) form a first layer mounted on a substrate 484, and the second, third, sixth and seventh resonators (452, 453, 456, 457) of FIG. 5C form a second layer positioned above the first layer.

Figure 6:
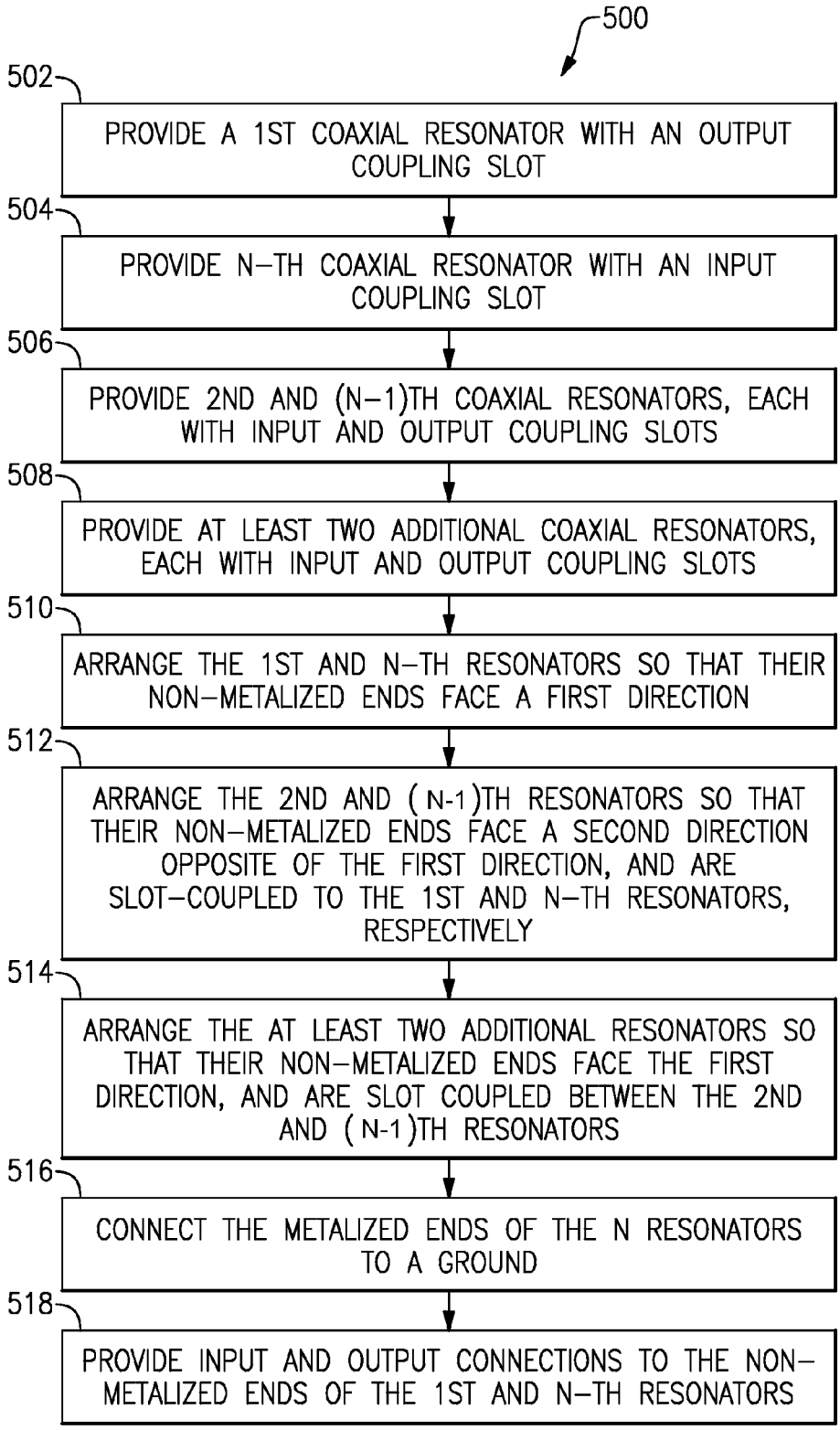
FIG. 6 shows a process that can be implemented to fabricate a filter having one or more features of the present disclosure.

FIG. 6 shows a process 500 that can be implemented to fabricate an RF filter having one or more features as described herein. In block 502, a first coaxial resonator with an output coupling slot can be provided. In block 504, an N-th coaxial resonator with an input coupling slot can be provided. In block 506, second and (N−1)th coaxial resonators can be provided. Each of such resonators can include input and output coupling slots. In block 508, at least two additional coaxial resonators can be provided. Each of such at least two additional resonators can include input and output coupling slots. In block 510, the first and N-th resonators can be arranged so that their non-metalized ends face a first direction. In block 512, the second and (N−1)th resonators can be arranged so that their non-metalized ends face a second direction opposite of the first direction. The first and second resonators can be slot coupled, and the Nth and (N−1)th resonators can be slot coupled. In block 514, the at least two additional resonators can be arranged between the second and (N−1)th resonators, and so that their non-metalized ends face the first direction. The end ones of the at least two resonators can be slot coupled with the second and (N−1)th resonators. In block 516, metalized ends of the N resonators can be connected to a ground. In block 518, input and output connections can be provided to the non-metalized ends of the first and N-th resonators.

Figure 7:
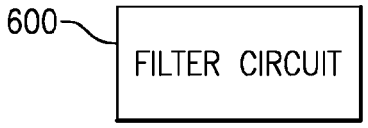
FIG. 7 schematically shows that one or more features of the present disclosure can be implemented as a filter circuit.
Figure 8:
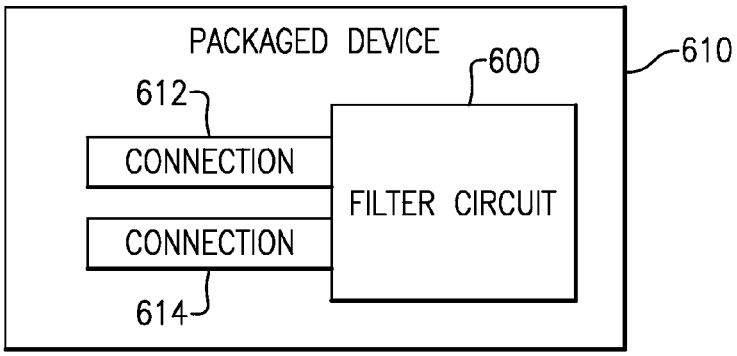
FIG. 8 shows that the filter circuit of FIG. 7 can be implemented in a packaged device.

FIG. 7 schematically shows that one or more features of the present disclosure can be implemented as a filter circuit 600. Such a filter circuit can be implemented in a number of products, devices, and/or systems. For example, FIG. 8 shows that in some embodiments, a packaged device 610 can include a filter circuit 600 configured to be coupled to input and output connections 612, 614 on a same side and provide performance features as described herein. Such a packaged device can be a dedicated RF filter module, or include some other functional components.

Figure 9:
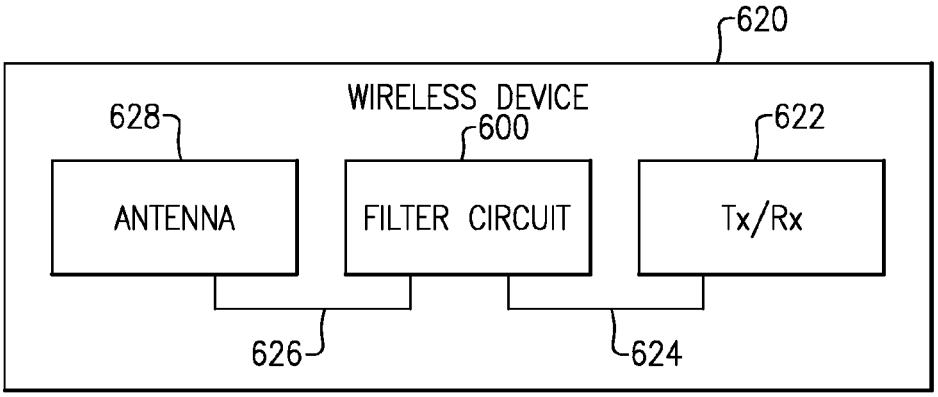
FIG. 9 shows that the filter circuit of FIG. 7 can be implemented in a wireless device.

FIG. 9 shows that in some embodiments, a filter circuit 600 can be implemented in a wireless device 620. Such a wireless device can include an antenna 628 in communication with the filter circuit (line 626). The wireless device 620 can further include a circuit 622 configured to provide transmit (Tx) and/or receive (Rx) functionalities. The Tx/Rx circuit 622 is shown to be in communication with the filter circuit 600 (line 624).

Figure 10:
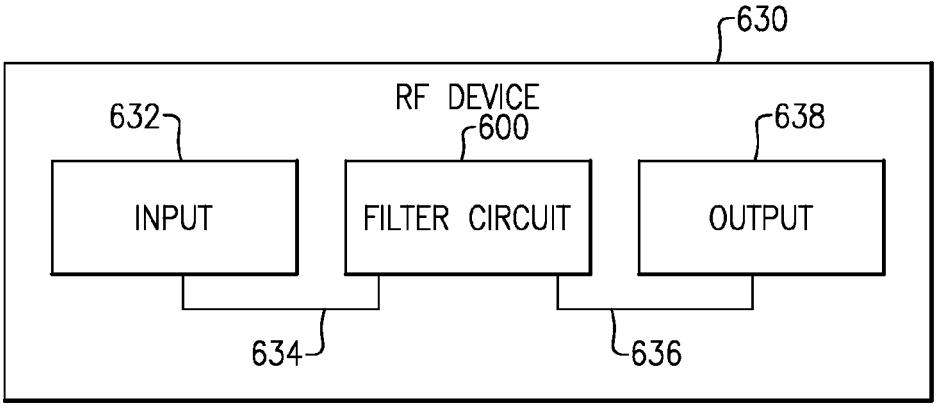
FIG. 10 shows that the filter circuit of FIG. 7 can be implemented in a wire-based of wireless RF device.

FIG. 10 shows that in some embodiments, a filter circuit 600 can be implemented in an RF device 630. Such a device can include an input component 632 that provides an input RF signal to the filter circuit (line 634), and an output component 638 that receives a filtered RF signal from the filter circuit 600 (line 636). The RF device 630 can be a wireless device such as the example of FIG. 9, a wire-based device, or some combination thereof.

In some implementations, RF filters having one or more band pass filtering features as described herein can be utilized in a number of applications involving systems and devices. Such applications can include but are not limited to cable television (CATV); wireless control system (WCS); microwave distribution system (MDS); industrial, scientific and medical (ISM); cellular systems such as PCS (personal communication service), digital cellular system (DCS) and universal mobile communications system (UMTS); and global positioning system (GPS). Other applications are also possible.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." The word "coupled", as generally used herein, refers to two or more elements that may be either directly connected, or connected by way of one or more intermediate elements. Additionally, the words "herein," "above," "below," and words of similar import, when used in this application, shall refer to this application as a whole and not to any particular portions of this application. Where the context permits, words in the above Detailed Description using the singular or plural number may also include the plural or singular number respectively. The word "or" in reference to a list of two or more items, that word covers all of the following interpretations of the word: any of the items in the list, all of the items in the list, and any combination of the items in the list.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while processes or blocks are presented in a given order, alternative embodiments may perform routines having steps, or employ systems having blocks, in a different order, and some processes or blocks may be deleted, moved, added, subdivided, combined, and/or modified. Each of these processes or blocks may be implemented in a variety of different ways. Also, while processes or blocks are at times shown as being performed in series, these processes or blocks may instead be performed in parallel, or may be performed at different times.

The teachings of the invention provided herein can be applied to other systems, not necessarily the system described above. The elements and acts of the various embodiments described above can be combined to provide further embodiments.

While some embodiments of the inventions have been described, these embodiments have been presented by way of example only, and are not intended to limit the scope of the disclosure. Indeed, the novel methods and systems described herein may be embodied in a variety of other forms; furthermore, various omissions, substitutions and changes in the form of the methods and systems described herein may be made without departing from the spirit of the disclosure. The accompanying claims and their equivalents are intended to cover such forms or modifications as would fall within the scope and spirit of the disclosure.

What is claimed is:

1. A radio-frequency (RF) filter, comprising:

a first coaxial resonator in a first orientation and having an input tab on a first side of the filter defined by N coaxial resonators;

an N-th coaxial resonator in the first orientation and having an output tab on the first side of the filter;

a second coaxial resonator in a second orientation opposite the first orientation so as to form a first interdigitation with the first coaxial resonator;

an (N−1)th coaxial resonator in the second orientation so as to form a second interdigitation with the N-th coaxial resonator;

at least two coaxial resonators in the first orientation and coupled between the second and (N−1)th coaxial resonators;

the N coaxial resonators configured to provide slot coupling between adjacent ones of the N coaxial resonators, the first and second interdigitations configured to provide enhancement of the slot coupling between the first and second coaxial resonators and between the (N−1)th and N-th coaxial resonators.

2. The RF filter of claim 1 wherein each of the N coaxial resonators includes a ceramic coaxial resonator.

3. The RF filter of claim 2 wherein each of the N ceramic coaxial resonator is configured as a quarter-wave resonator.

4. The RF filter of claim 3 wherein each of the N quarter-wave resonators includes a non-metalized end and a metalized end, the metalized end electrically connected to a ground.

5. The RF filter of claim 4 wherein the quantity N is an integer greater than or equal to 6.

6. The RF filter of claim 5 wherein the quantity N is 6.

7. The RF filter of claim 6 wherein each of the first coaxial resonator, a third coaxial resonator, a fourth coaxial resonator and a sixth coaxial resonator of the 6-coaxial resonator filter having respective non-metalized ends facing the first side of the filter, and each of the second coaxial resonator and a fifth coaxial resonator of the 6-coaxial resonator filter having respective metalized ends facing the first side of the filter.

8. The RF filter of claim 5 wherein the quantity N is 7, each of the first coaxial resonator, a third coaxial resonator, a fourth coaxial resonator, a fifth coaxial resonator and a seventh coaxial resonator of the 7-coaxial resonator filter having respective non-metalized ends facing the first side of the filter, and each of the second coaxial resonator and a sixth coaxial resonator of the 7-coaxial resonator filter having respective metalized ends facing the first side of the filter.

9. The RF filter of claim 4 wherein the input tab is disposed on the non-metalized end which is disposed at the first side of the first coaxial resonator and the output tab is disposed on the non-metalized end which is disposed at the first side of the N-th coaxial resonator.

10. The RF filter of claim 9 further comprising an input capacitor connected to the input tab, and an output capacitor connected to the output tab.

11. The RF filter of claim 10 further comprising an input connector connected to the input capacitor, and an output connector connected to the output capacitor.

12. The RF filter of claim 11 wherein the input and output connectors, input and output capacitors, and input and output tabs are substantial mirror images of each other.

13. A radio-frequency (RF) device, comprising:

a first RF component configured to generate an RF signal;

an RF filter defined by N coaxial resonators that includes a first coaxial resonator in a first orientation and having an input tab on a first side of the filter for receiving the RF signal, an N-th coaxial resonator in the first orientation and having an output tab on the first side of the filter, a second coaxial resonator in a second orientation opposite the first orientation so as to form a first interdigitation with the first coaxial resonator, an (N−1) th coaxial resonator in the second orientation so as to form a second interdigitation with the N-th coaxial resonator, and at least two coaxial resonators in the first orientation and coupled between the second and (N−1) th coaxial resonators, the N coaxial resonators configured to provide slot coupling between adjacent ones of the N coaxial resonators, the first and second interdigitations configured to provide enhancement of the slot coupling between the first and second coaxial resonators and between the (N−1)-th and N-th coaxial resonators; and a second RF component connected to the output tab of the RF filter and configured to receive a filtered RF signal from the RF filter.

14. The RF device of claim 13 wherein the RF filter is a band pass filter.

15. The RF device of claim 13 wherein the RF device includes a wireless device.

16. The RF device of claim 15 wherein the wireless device includes a device associated with a cellular system.

17. The RF device of claim 13 wherein the RF device includes a wire-based device.

18. The RF device of claim 17 wherein the wire-based device includes a device associated with a cable television system.

* * * * *